US007335097B2

(12) United States Patent
Tomita et al.

(10) Patent No.: US 7,335,097 B2
(45) Date of Patent: Feb. 26, 2008

(54) DOCUMENT CARRIER SHEET

(75) Inventors: Naoki Tomita, Akishima (JP); Tadashi Obara, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 484 days.

(21) Appl. No.: 10/304,999

(22) Filed: Nov. 27, 2002

(65) Prior Publication Data

US 2003/0100354 A1 May 29, 2003

(30) Foreign Application Priority Data

Nov. 28, 2001 (JP) ..... 2001-362866

(51) Int. Cl.
*B41L 1/26* (2006.01)
*B41L 3/00* (2006.01)

(52) U.S. Cl. ..... 462/6; 462/71; 462/25; 283/81

(58) Field of Classification Search ..... 462/6, 462/8, 9, 25, 71, 84; 281/2, 5; 283/61, 62, 283/81

See application file for complete search history.

(56) References Cited

U.S. PATENT DOCUMENTS

| | | | | |
|---|---|---|---|---|
| 4,278,199 | A * | 7/1981 | Tanaka | 229/92.8 |
| 4,730,848 | A * | 3/1988 | McCormick | 462/55 |
| 4,799,712 | A * | 1/1989 | Biava et al. | 462/67 |
| 5,090,943 | A * | 2/1992 | Greig et al. | 462/71 |
| 5,352,155 | A * | 10/1994 | Fahey | 462/25 |
| 2003/0100354 | A1 * | 5/2003 | Tomita et al. | 462/6 |

FOREIGN PATENT DOCUMENTS

| | | |
|---|---|---|
| JP | 59-119662 | 8/1984 |
| JP | 59-189373 | 12/1984 |
| JP | 1-173736 | 12/1989 |
| JP | 7-135602 | 5/1995 |

* cited by examiner

*Primary Examiner*—Dana Ross
(74) *Attorney, Agent, or Firm*—Oblon, Spivak, McClelland, Maier & Neustadt, P.C.

(57) ABSTRACT

A document carrier sheet is provided with a support sheet having a support surface on which a document is supported. The document carrier sheet is also provided with a transparent sheet attached to the support sheet and permitting the document to be held on the support surface, with an image on the document being covered. The support surface of the support sheet has a different color from that of the document.

1 Claim, 8 Drawing Sheets

DOCUMENT CARRIER SHEET

CROSS-REFERENCE TO RELATED APPLICATIONS

This application is based upon and claims the benefit of priority from the prior Japanese Patent Application No. 2001-362866, filed Nov. 28, 2001, the entire contents of which are incorporated herein by reference.

BACKGROUND OF THE INVENTION

1. Field of the Invention

The present invention relates to a document carrier sheet, for example, to a document carrier sheet applied to a document feed type scanner.

2. Description of the Related Art

In a document feed type scanner (which is an example of a read device of an optical character recognition apparatus), documents are irradiated with light when they are being fed, and the light reflected by them is received by an image sensor after passing through an optical system. Image information is obtained by the image sensor.

Where the documents are thin paper or carbon paper, the document feed type scanner is likely to feed two documents simultaneously or may cause a paper jam, and therefore does not ensure a reliable feed operation at all times. In an effort to solve this problem, a document carrier sheet is used, and the thin paper or carbon paper is inserted in the document carrier sheet.

The document carrier sheet is made up of: a base sheet serving as a support sheet on which documents are supported; and a transparent sheet which is laid over the base sheet and adhered to it at a forward end portion as viewed in the feed direction and at both side portions as viewed in the direction orthogonal to the feed direction.

In general, an image processing apparatus starts recognition processing by detecting edges of a document or the entirety of that document.

In the conventional art, however, the base sheet of the document carrier sheet is white. In other words, the background of documents is white, the same color as the documents themselves. Since the edges of the documents are therefore hard to detect, the conventional document carrier sheet is not suitable for use in an image processing apparatus.

In addition, the transparent sheet is adhered to the base sheet at the forward end portion and at both side portions. With this structure, documents that are larger than the base sheet cannot be fed, and the use of the document carrier sheet is not suitable for the recognition performed by the image processing apparatus.

In ordinary cases, a number of document carrier sheets are set in the sheet takeout section of a scanner and are taken out one by one from the sheet takeout section. After being taken out, the document carrier sheets are checked with respect to their thicknesses so as to detect whether or not two document carrier sheets have been fed simultaneously.

Each document carrier sheet holding a document is in three layers (namely, the base sheet, the document, and the transparent sheet), and in this state it is transported and subjected to thickness sensing. It is therefore hard for the thickness sensor to accurately sense the thicknesses.

BRIEF SUMMARY OF THE INVENTION

The present invention has been made in consideration of the above circumstances, and an object of the invention is to provide a document carrier sheet which ensures reliable detection of a document edge, enables the feeding of a document that is larger than a support sheet, and enables reliable sensing of two document carrier sheets being fed simultaneously.

According to the first aspect of the present invention, a document carrier sheet comprises:

a support sheet having a support surface on which a document to be optically read is supported; and a transparent sheet provided for the support sheet and permitting the document to be held on the support surface, the support surface of the support sheet being different in color from the document.

According to the second aspect of the present invention, a document carrier sheet comprises:

a support sheet having a support surface on which a document to be optically read is supported; and a transparent sheet provided for the support sheet and permitting the document to be held on the support surface, the transparent sheet being shifted from the support sheet from one side toward the other by a predetermined distance in a direction orthogonal to the feed direction of the document carrier sheet.

According to the third aspect of the present invention, a document carrier sheet comprises:

a support sheet having a support surface on which a document to be optically read is supported; and a transparent sheet provided for the support sheet and permitting the document to be held on the support surface, the transparent sheet being shifted from the support sheet rearward by a predetermined distance in the feed direction of the document carrier sheet.

According to the fourth aspect of the present invention, a document carrier sheet comprises:

a support sheet having a support surface on which a document to be optically read is supported; and a transparent sheet provided for the support sheet and permitting the document to be held on the support surface, a plurality of depressions arranged at regular intervals and depressed toward the support surface being formed along a boundary between the support surface of the support sheet and the other portions thereof, the transparent sheet being adhered to portions which are within the depressions and to outer peripheral portions of the depressions of the support surface.

According to the fifth aspect of the present invention, a document carrier sheet comprises:

a support sheet having a support surface on which a document to be optically read is supported; and a transparent sheet provided for the support sheet and permitting the document to be held on the support surface, the transparent sheet being made of an antireflection material.

According to the sixth aspect of the present invention, a document carrier sheet comprises:

a support sheet having a support surface on which a document to be optically read is supported; and a transparent sheet provided for the support sheet and permitting the document to be held on the support surface, the support sheet serving as the support surface, except for a forward end portion as defined in the feed direction of the document carrier sheet and a one-side portion as defined in a direction orthogonal to the feed direction, the forward end portion and the one-side portion being adhered to outer peripheral portions of the support surface of the support sheet, the transparent sheet being not adhered at a rear end portion as defined in the feed direction and another-side portion as defined in the direction orthogonal to the feed direction.

According to the seventh aspect of the present invention, a document carrier sheet comprises:

a support sheet having a support surface on which a document to be optically read is supported; and a transparent sheet provided for the support sheet and permitting the document to be held on the support surface, the support sheet and the transparent sheet being rectangular whose short sides extend in the feed direction of the document carrier sheet and whose long sides extend in a direction orthogonal to the feed direction, the transparent sheet being adhered to outer peripheral portions of the support surface at a forward end portion as defined in the feed direction and at a one-side portion as defined in the direction orthogonal to the feed direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will now be described in detail, referring to the embodiments shown in the accompanying drawings.

Figure 1:
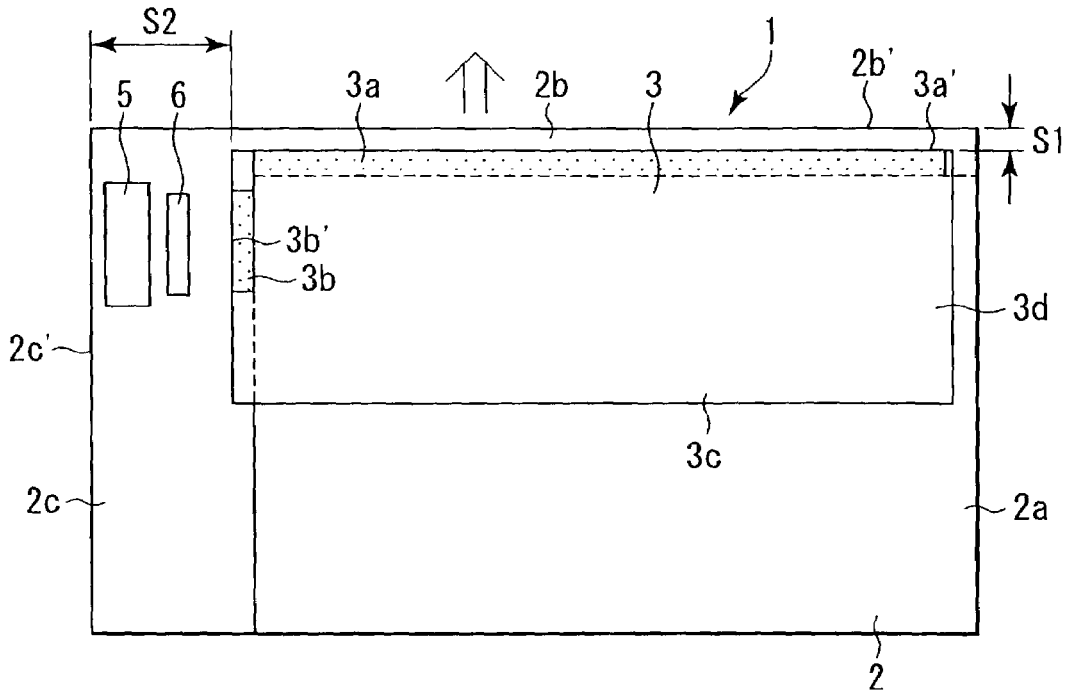
FIG. 1 is a plan view of a document carrier sheet according to one embodiment of the present invention.

FIG. 1 shows a document carrier sheet 1 according to one embodiment of the present invention. The carrier sheet 1 comprises: a rectangular support sheet 2 on which a document is supported; and a rectangular transparent sheet 3 adhered to the support sheet 2 and permitting the document to be held on the support sheet 2. The carrier sheet 1 is set on the scanner, and it is then taken out and conveyed in the direction parallel to the short sides of the document, as indicated by the arrow in FIG. 1.

The support sheet 2 of the carrier sheet 1 has a support surface 2*a* on which the document is held. The support surface 2*a* corresponds to those portions of the support sheet 2 which are other than a forward end region as defined in the feed direction of the support sheet 2 and a one-side region 2*c* as defined in the direction orthogonal to the feed direction. The support surface 2*a* is black, while the other portions of the support sheet 2 are white. In this manner, a color difference is provided between the support surface 2*a* and regions 2*b* and 2*c*.

The transparent sheet 3 is adhered to the outer peripheral portion of the support surface 2*a* at a forward end portion 3*a* as defined in the feed direction and at a one-side portion 3*b* as defined in the direction orthogonal to the feed direction. Of the portions of the transparent sheet 3, a rearward end portion 3*c* as defined in the feed direction and the other-side portion 3*d* are not adhered. They are open and can be separated from the support surface 2*a*. In the feed direction, the dimension of the transparent sheet 3 is substantially half that of the support surface 2*a*.

The forward end 3*a*′ of the transparent sheet 3 is shifted rearward from the forward end 2*b*′ of the support sheet 2 by distance S1. Likewise, the one-side edge 3*b*′ of the transparent sheet 3 is shifted from the one-side edge 2*c*′ of the support sheet 2 by distance S2.

The transparent sheet 3 is formed of an antireflection material. Light incident on the sheet 3 is not reflected but transmitted through the sheet, and the document is irradiated with the light.

Figure 2:
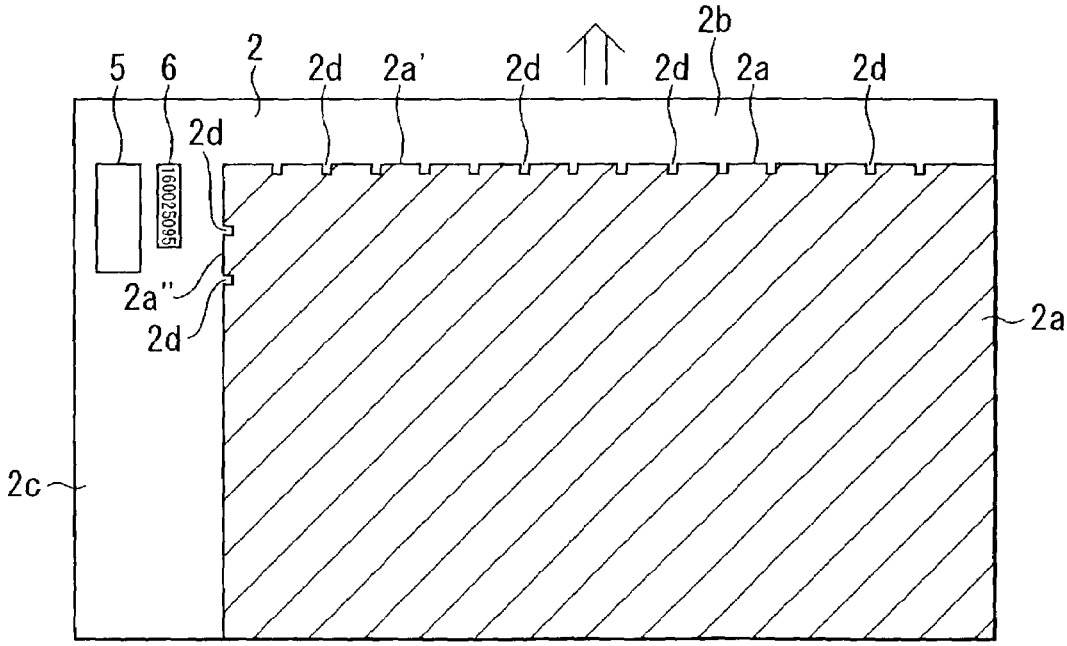
FIG. 2 is a plan view showing the support sheet of the carrier sheet depicted in FIG. 1.

FIG. 2 is a plan view of the support sheet 2.

As shown in FIG. 2, a plurality of depressions 2*d* are arranged at predetermined intervals along the boundary between the support surface 2*a* of the support sheet 2 and the other regions 2*b* and 2*c* thereof. Each of the depressions 2*d* is depressed toward the support surface. The portions inside the depressions 2*d* are white. The forward end portion 3*a* and the one-side portion 3*b* of the transparent sheet 3 are adhered not only to the outer peripheral portion of the support surface 2*a* of the support sheet 2 but also to the portions inside the depressions 2*d*.

A seal member 5, the thickness of which is substantially equal to the total thickness of the transparent sheet 3 and the document combined, is attached to the one-side region 2*c* of the support sheet 2. A document number is printed at a position adjacent to the seal member 5.

Figure 3:
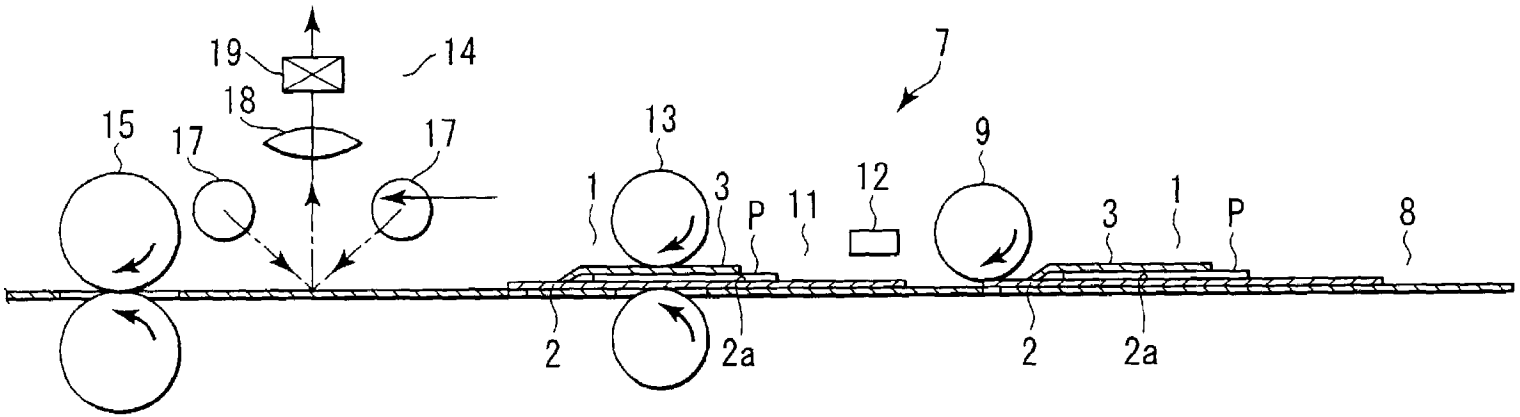
FIG. 3 is a schematic diagram showing a scanner which reads an image from a document held in the carrier sheet depicted in FIG. 1.

FIG. 3 shows a scanner 7 which acquires an image from a black background.

In FIG. 3, numeral 8 denotes a setting section on which a plurality of carrier sheets 1 each containing a document P can be set. A delivery roller 9 is provided in the setting section 8 to take out the carrier sheet 1.

The carrier sheet 1 taken out by the delivery roller 9 is transported along a transport path 11. The transport path 11 is provided with a thickness sensor 12, a pair of transport rollers 13, a read section 14 and a pair of discharge rollers 15. These structural elements are arranged in the feed direction of the carrier sheet 1.

The read section 14 includes: a pair of illumination lamps 17 which irradiate the document P with light; an image-forming lens 18 which converges the light reflected by the document P; and an image sensor 19 on which an image is formed by the image-forming lens 18.

Figure 4:
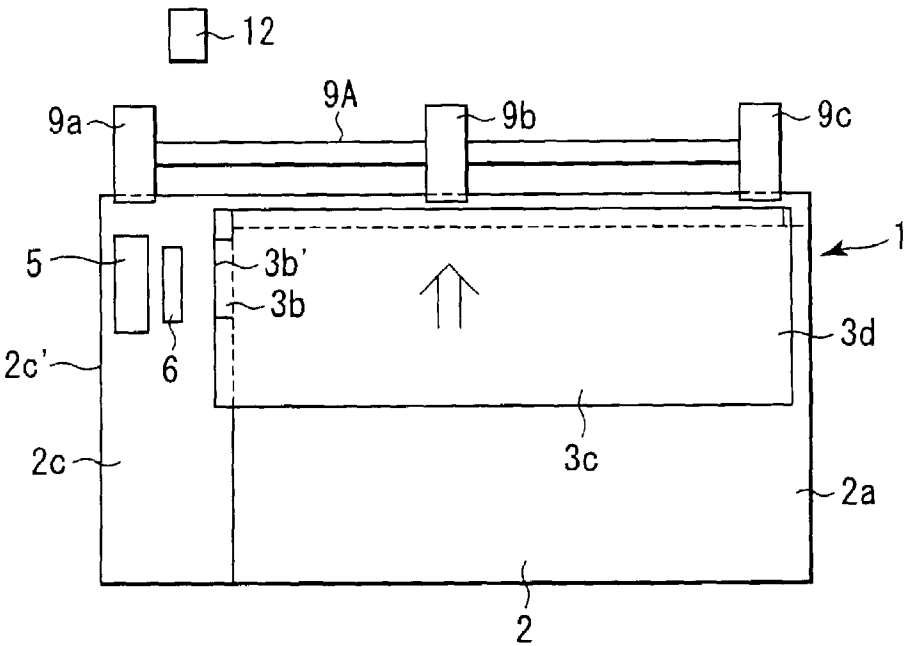
FIG. 4 is a plan view showing an arrangement of a delivery roller and a read sensor, which are parts of the scanner illustrated in FIG. 3.

FIG. 4 shows how the delivery roller 9 and the thickness sensor 12 are arranged.

The delivery roller 9 includes a shaft 9A, and a plurality of rollers 9*a*, 9*b* and 9*c* attached to the shaft 9A and spaced from each other by predetermined intervals. Roller 9*a*, which is located at one end of the shaft 9A, comes into contact with the seal member 5 of the support sheet 2. Rollers 9*b* and 9*c*, which are located at the center and the other end of the shaft 9A respectively, come into contact with the transparent sheet 3. The thickness sensor 12 opposes the one-side region 2*c* of the support sheet 2. An ultrasonic sensor can be used as the thickness sensor 12.

A description will now be given as to how the scanner 7 reads image information.

First of all, a document P is inserted between the support surface 2*a* of the support sheet 2 and the transparent sheet 3, with an image side upward. The carrier sheet 1, in which the document P is held, is set on the setting section 8, with the transparent sheet 3 upward.

After the carrier sheet 1 is set as above, the delivery roller 9 is rotated to take out the carrier sheet 1. The thickness sensor 12 senses the one-side region 2*c* of the support sheet 2 of the carrier sheet 1, so as to determine whether or not two carrier sheets have been taken out simultaneously.

If it is determined based on the sensing by the sensor 12 that two carrier sheets have been taken out, the operation of taking out carrier sheets is stopped. On the other hand, if it is determined that a single carrier sheet has been taken out, it is sandwiched by the transport rollers 13 and transported to the read section 14.

In the read section 14, the illumination lamps 17 emit light, and the light falls on the document P after passing through the transparent sheet 3 of the carrier sheet 1. The light reflected by the document P passes through the image-forming lens 18 and then falls on the image sensor 19. As a result, image information is read.

Figure 5:
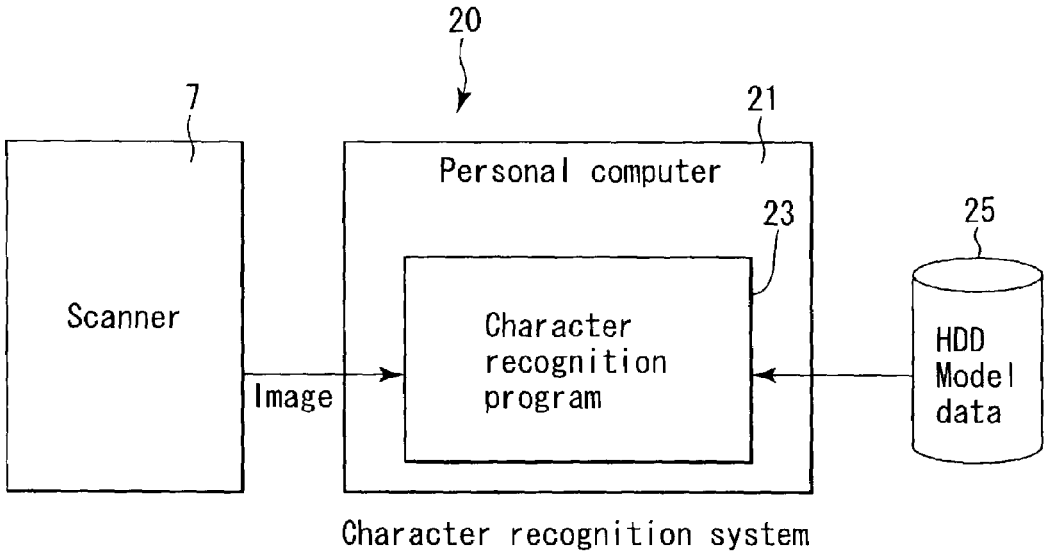
FIG. 5 is a diagram showing a character recognition system that is provided with the scanner illustrated in FIG. 3.
Figure 6:
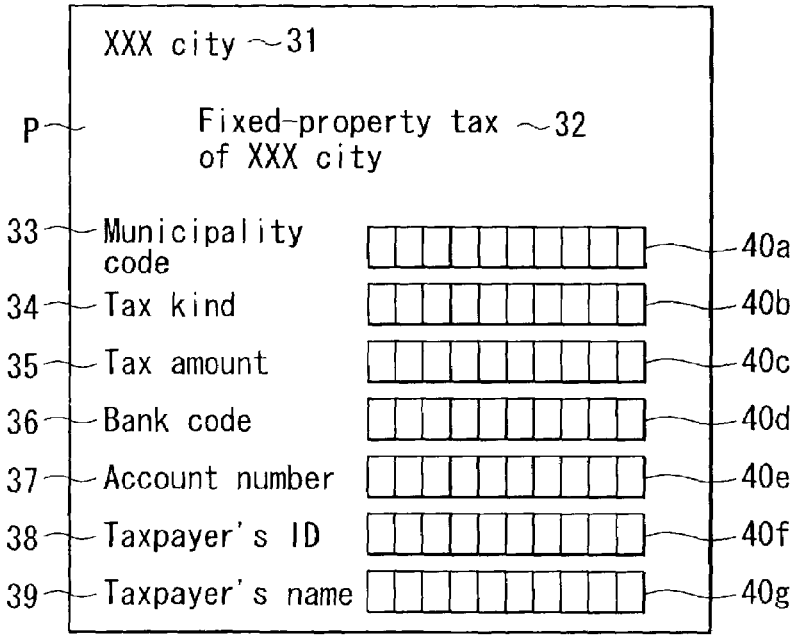
FIG. 6 is a plan view of a document which is to be read by the scanner illustrated in FIG. 3.

FIG. 5 shows the entire image information processing system 20. This processing system 20 is installed, for example, in a bank to read such a document P as shown in FIG. 6. The example shown in FIG. 6 is a fixed-property tax document and is submitted by a taxpayer at the bank.

On the document P the following information is printed: XXX [city name] City 31; Fixed-Property Tax 32 of XXX City; Municipality Code 33; Tax Kind 34; Tax Amount 35; Bank Code 36; Account Number 37; Taxpayer's ID 38; Taxpayer's Name 39; etc. Entries 40*a*-40*e* are printed in correspondence to the items of Municipality Code 33, Tax Kind 34, Tax Amount 35, Bank Code 36, Account Number 37, Taxpayer's ID 38, and Taxpayer's Name 39. Either a number with up to ten digits or a character string containing up to ten characters can be written in each of the entries 40*a*-40*e*. In place of these entries 40*a*-40*e*, numerals or characters may be preprinted.

The processing system 20 includes a personal computer 21 and an HDD 25 as well as the scanner 7 described above. Document-identifying models corresponding documents to be read are registered as data in the HDD 25.

An operation of the above processing system will now be described, referring to an example to which the present invention is applied.

A document P submitted to a bank clerk is first read by the scanner 7 in such a manner as described above. Then, an image of the document is sent to the personal computer 21, which stores a character recognition program 23.

Figure 7:
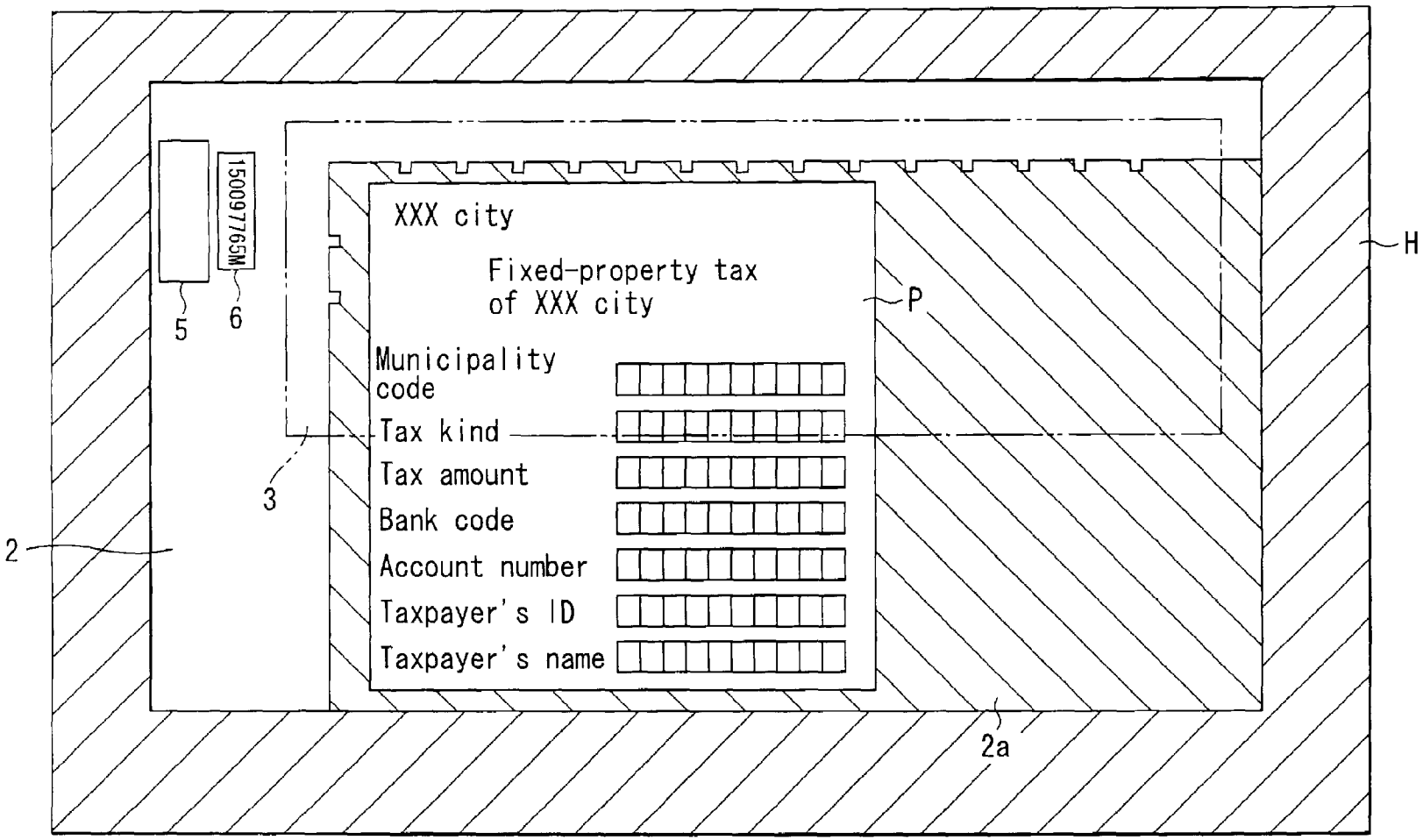
FIG. 7 is a plan view showing how the document is read when it is held in the carrier sheet depicted in FIG. 1.
Figure 8:
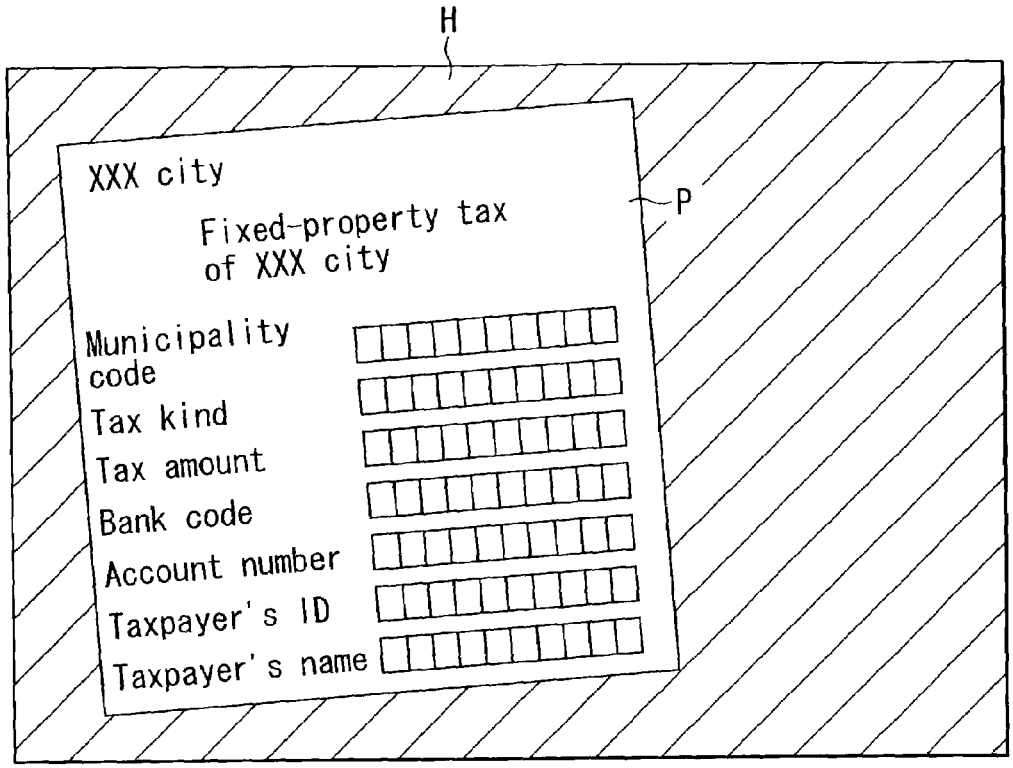
FIG. 8 is a plan view showing how the document is read when it is not held in the carrier sheet depicted in FIG. 1.
Figure 9:
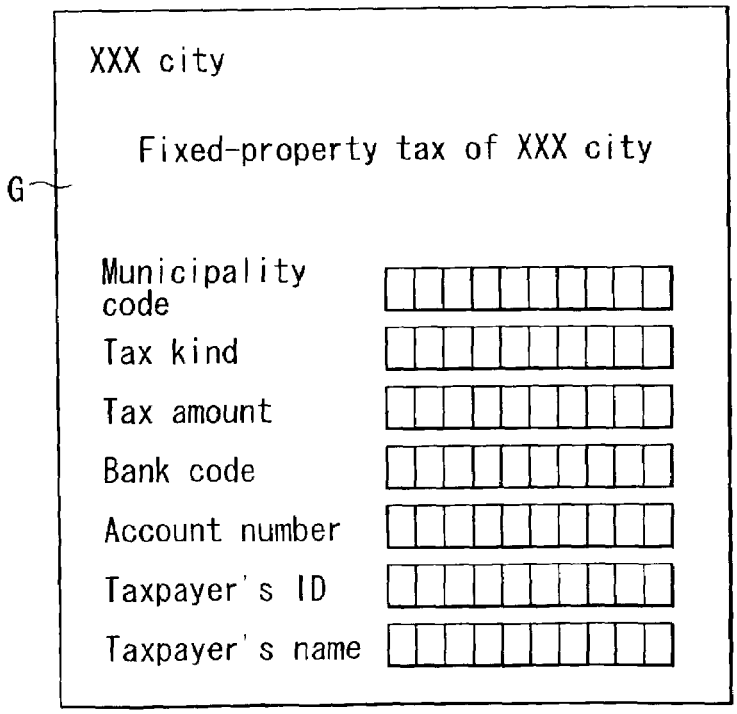
FIG. 9 is a plan view of an image of a document whose edges are trimmed by the character recognition system depicted in FIG. 5.

In a case where the shape of the depressions 2*d* at the edge of the black support surface 2*a* of the support sheet 2 of the carrier sheet 1 is read or the document number 6 of the carrier sheet 1 is read on the basis of the document image, then it is determined that the document P is transported while being held in the carrier sheet 1, as shown in FIG. 7. In the other cases, it is determined that the document P is transported without being held in the carrier sheet 1, as shown in FIG. 8.

Where it is determined that the document P is transported singly, the information read from the document P and a document model registered beforehand are subjected to a matching check, for identification of the document. After this identification, processing for recognizing the document model is executed, and read data and a read image are output. As shown in FIG. 9, image G is output, with a skew of the document P being corrected and the background of the image being removed.

Where it is determined that the document P is held in the carrier sheet 1, the four side edges of the document P are detected in the black region of the support surface 2*a* of the carrier sheet 1, and trimming processing is executed. After this trimming processing, the document is identified in a similar manner to that of the document P transported singly. After this identification, the document model is recognized, and read data and a read image are output.

Figure 10:
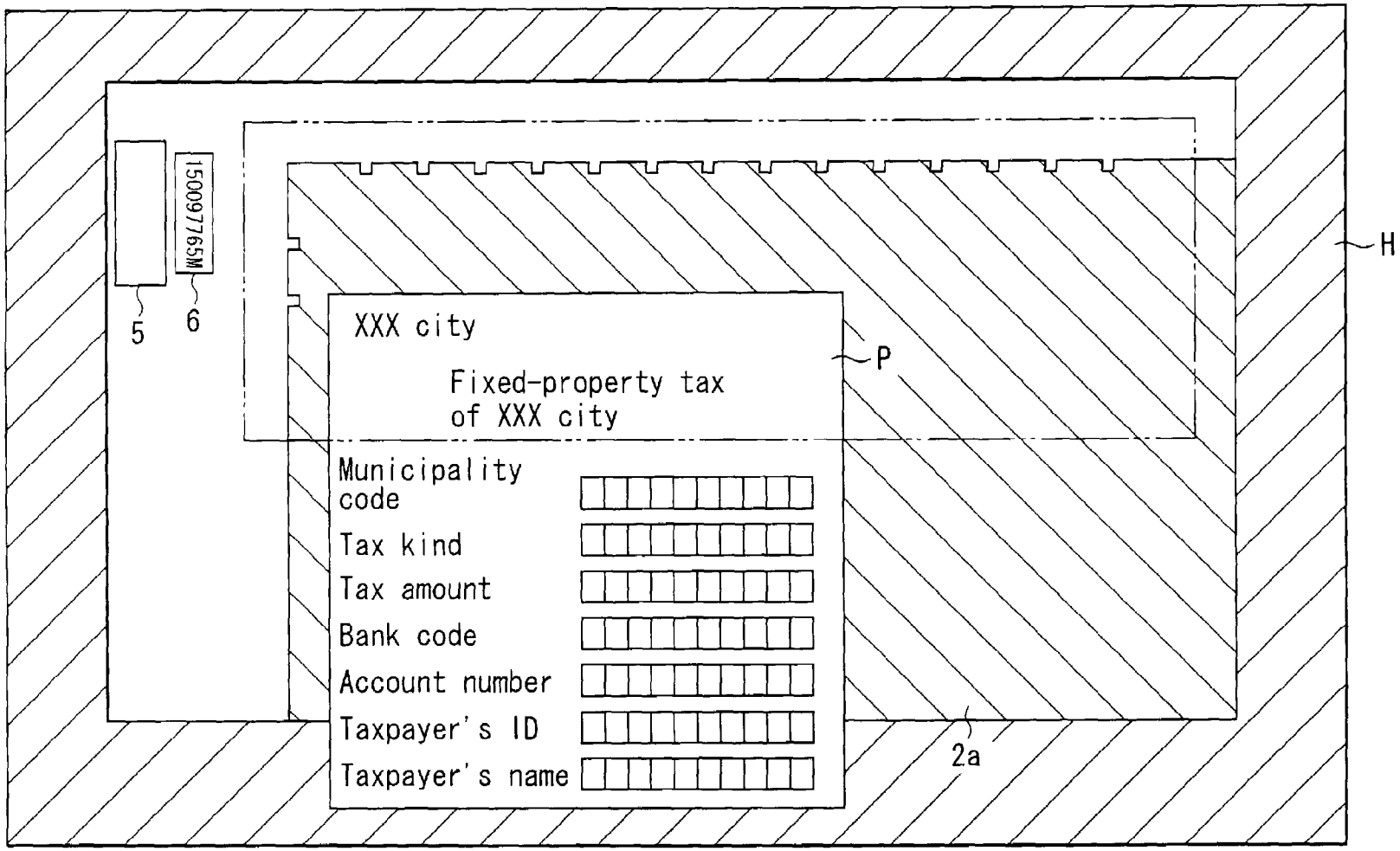
FIG. 10 is a plan view showing how the document is fed in the state where it partly lies off the edge of the carrier sheet depicted in FIG. 1.

On an image, both the background H and the support surface 2*a* of the support sheet 2 of the carrier sheet 1 look black. Therefore, even if the document P is transported with its part extended off the edge of the carrier sheet 1, as shown in FIG. 10, the edges of the document P can be detected with high accuracy, and enabling trimming processing is thus enabled.

Figure 11:
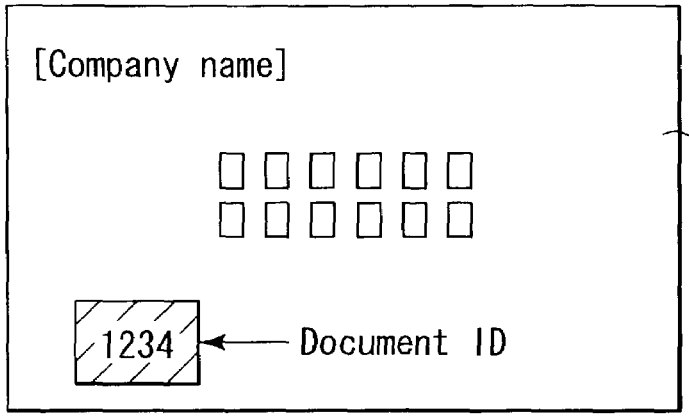
FIG. 11 is a plan view of another example of a document.

In the case where an entry portion (□ □ □ □ . . . ) of the document P, such as that shown in FIG. 11, is subjected to character recognition, the conventional art has to prepare a model used exclusively for reading the related field of the document P. Unless such a model is prepared and the document P is transported singly, the entry portion (□ □ □ □ . . . ) of the document P cannot be read.

If different kinds of documents are transported, IDs have to be printed at the predetermined positions on the documents. By reading the printed IDs, a model (format control data) corresponding to each ID is read out, and data must be read based on this model.

In the conventional art, a document that does not have a printed ID for OCR is recognized by executing document identification.

Figure 12:
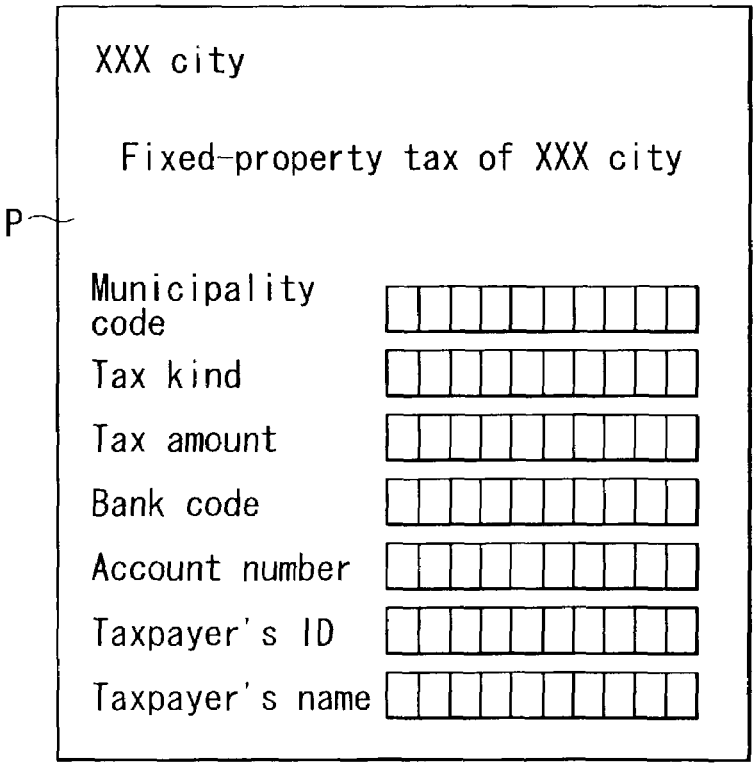
FIG. 12 illustrates preprint data and positional coordinates that are stored beforehand in relation to the document depicted in FIG. 6.
Figure 13:
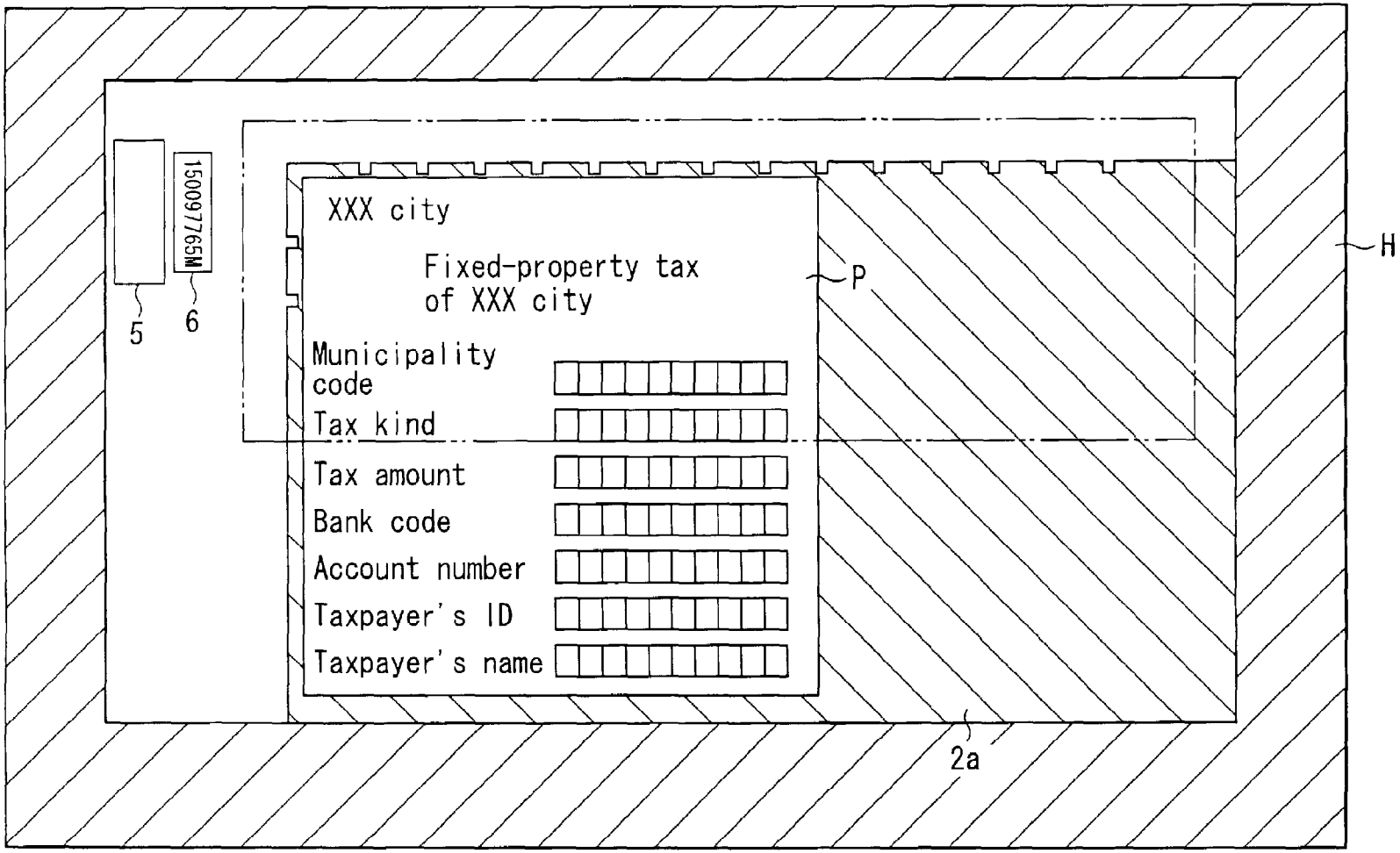
FIG. 13 shows a state where the document depicted in FIG. 6 is positioned, with one side edge thereof being in contact with the depressions of the support surface of the carrier sheet.

As shown in FIG. 12, the document is first subjected to a matching process wherein the document size, the preprint, the position of the preprint, the document shape, etc. are compared with those of a document model registered beforehand, as can be seen from 12. Based on this, the document is identified. After the identification, the data in the entries is recognized.

As described above, in the present invention, the support surface 2*a* of the support sheet 2 is black, and this provides a color difference between the support surface 2*a* and the document P. Since the background color of the document P is the same as the document background color of the scanner 7, the document position can be easily determined based on the scan image, thereby enabling image reading.

The support sheet 2 is entirely black, except for the forward end portion 2*b* and the one-side portion, and the rear end portion 3*c* and the other-side portion 3*d* are openable without being adhered to the support sheet 2. With this structure, even if the document is skewed and is partly off the edge of the carrier sheet 1, the document position can be accurately determined and information can be reliably read from the document.

The transparent sheet 3 is adhered to the outer peripheral portion of the support surface 2*a* of the support sheet 2 and the portions inside the depressions 2*d*, and the adhered portions of the transparent sheet 3 are limited to the forward end portion 3*a* and the one-side portion 3*b*. With this structure, the document P inserted between the support sheet 2 and the transparent sheet 3 is positioned when it comes into contact with the adhered portions between the transparent sheet 3 and the depressions 2*d*.

Therefore, the document P can be reliably positioned within the support surface 2*a* of the support sheet 2. In other words, the edges of the document P are not prevented from overlapping with the edges of the support surface 2*a*. Hence, the edges of the document P can be reliably detected.

In the feed direction, the dimension of the transparent sheet 3 is substantially half that of the support surface 2*a*. With this structure, the document P can be easily inserted between the support sheet 2 and the transparent sheet 3.

In addition, the transparent sheet 3 is adhered to the support sheet 2 in such a manner that the adhesion area extending in the lengthwise direction of the support sheet 2 is greater than the adhesion area extending in the widthwise direction. Since the support sheet 2 is likely to extend or contract greatly in the lengthwise direction, the deformation of the transparent sheet 3 can be suppressed.

Since the forward end 3*a* of the transparent sheet 3 is shifted rearward from the forward end 2*b*′ of the support sheet 2 by distance S1, the delivery roller 9 first contacts the forward end 3*b* of the support sheet 2 and then contacts the forward end 3*a* of the transparent sheet 3 when the carrier sheet 1 is taken out. With this structure, the delivery roller 9 does not strike hard against the forward end 3*a* of the transparent sheet 3, and the transparent sheet 3 is prevented from separating the support sheet 2.

Furthermore, the one-side edge 3*b*′ of the transparent sheet 3 is shifted from the one-side edge 2*c*′ of the support sheet 2 toward the other side by distance S2, and the thickness sensor 12 senses the thickness of the one-side edge 3*c* of the support sheet 2. Therefore, what the thickness sensor 12 senses is the thickness of the support sheet 2 itself, and the thickness of the transparent sheet 3 and that of the document P are not sensed. Since the accuracy with which to sense the carrier sheet 1 is enhanced, two carrier sheets are not fed simultaneously.

Since the transparent sheet 3 is formed of an antireflection material, it does not reflect the light incident thereon. The light passes through the sheet 3 and reaches the document.

The seal member 5, which has the substantially the same thickness as the transparent sheet 3, is attached to the one-side region 2*c* of the support sheet 2. Since the carrier sheet 1 is uniform in thickness as viewed in the feed direction, it can be reliably taken out and transported.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A document carrier sheet comprising:

a support sheet including first, second, third, and fourth edges, and a support surface to support a surface opposite to a reading surface of a document;

a transparent sheet adhered to the support sheet to cover the reading surface of the document supported on the support surface, wherein the support sheet is carried with the first edge thereof at a head to optically read an image of the document from the transparent sheet, the support surface is formed in a first color between the second edge of the support sheet and a position shifted by a predetermined distance at least from the first edge of the support sheet toward the second edge opposed to the first edge, the support surface being different in color form a non-support surface of the support sheet formed in a second color, and a plurality of depressions being arranged along a boundary between the support surface and the non-support surface toward the support surface, and the transparent sheet includes a leading edge that is adhered to an outer peripheral portion of the support surface of the support sheet and the depressions.

* * * * *